US010912365B2

(12) United States Patent
Quagliara

(10) Patent No.: US 10,912,365 B2
(45) Date of Patent: Feb. 9, 2021

(54) NAIL POLISH REMOVAL APPARATUS

(71) Applicant: Daniella Quagliara, Toronto (CA)

(72) Inventor: Daniella Quagliara, Toronto (CA)

( * ) Notice: Subject to any disclaimer, the term of this patent is extended or adjusted under 35 U.S.C. 154(b) by 750 days.

(21) Appl. No.: 15/627,897

(22) Filed: Jun. 20, 2017

(65) Prior Publication Data

US 2018/0360188 A1 Dec. 20, 2018

(51) Int. Cl.
*A45D 29/17* (2006.01)
*A45D 29/00* (2006.01)

(52) U.S. Cl.
CPC ..... *A45D 29/007* (2013.01); *A45D 29/17* (2013.01); *Y10T 24/4447* (2015.01)

(58) Field of Classification Search
CPC ..... A45D 29/007; A45D 29/17; A45D 8/20; A45D 8/22; A45D 8/24; D06F 55/02; D06F 55/00; Y10T 24/44453; Y10T 24/4447; Y10T 24/444385; A47L 13/022; A47L 17/08; A41H 15/00
USPC ..... 24/510; D28/7; D8/395; 15/299.13, 15/244.1, 210.1, 209.1, 229.13; D32/52, D32/61, 62, 64; 294/99.2
See application file for complete search history.

(56) References Cited

U.S. PATENT DOCUMENTS 1,438,794 A * 12/1922 Tudor ..... A47L 13/46 15/229.13
2,137,631 A 11/1938 Stern
2,180,519 A 11/1939 Hamilton et al.
2,804,636 A 9/1957 Sadler
2,922,209 A * 1/1960 Longhi ..... D06F 55/02 24/501
3,084,368 A * 4/1963 Kolk ..... A47L 13/46 15/229.13
3,369,553 A 2/1968 Keesee
3,524,226 A * 8/1970 Brown ..... A47G 25/481 223/85
3,600,764 A * 8/1971 Froehlich ..... A47L 13/512 24/545
4,175,306 A * 11/1979 Bigelow ..... A47G 25/485 24/507
5,027,839 A * 7/1991 Appell ..... A45D 29/007 132/285
D322,519 S * 12/1991 Holtz ..... D11/48
5,439,012 A * 8/1995 D'Agostino ..... A45D 29/007 132/73
5,642,913 A 7/1997 Brown
(Continued)

FOREIGN PATENT DOCUMENTS

FR 787275 * 9/1935 ..... A44C 1/00
FR 2 952 792 B3 5/2011

OTHER PUBLICATIONS

Mainstay Standard Wooden Clothespins, https://www.amazon.com/Mainstay-Standard-Wooden-Clothespins-100-count/dp/B00KTO0OE4/ref=cm_cr_arp_d_bdcrb_top?ie=UTF8, Feb. 3, 2015 (see oldest review on p. 5), pp. 1-5.*
(Continued)

*Primary Examiner* — Tatiana L Nobrega
(74) *Attorney, Agent, or Firm* — Bereskin & Parr LLP/S.E.N.C.R.L., s.r.l.; Tony Orsi

(57) ABSTRACT

An apparatus for removing nail polish, the apparatus comprising a first grip member, a second grip member, a first removal support region, a second removal support region, and a biasing portion to couple and bias the first and second grip members towards one another.

12 Claims, 5 Drawing Sheets

(56) References Cited

U.S. PATENT DOCUMENTS

| | | | | |
|---|---|---|---|---|
| D418,630 | S * | 1/2000 | Flory | D28/7 |
| D521,368 | S * | 5/2006 | Carl | D8/395 |
| 7,421,972 | B1 * | 9/2008 | Long | G09F 17/00 116/173 |
| D697,397 | S * | 1/2014 | Goodman | D8/395 |
| D721,455 | S | 1/2015 | Soplos-Schaffer et al. | |
| D753,991 | S * | 4/2016 | Pan | D8/395 |
| 9,655,426 | B2 * | 5/2017 | Bremner | A45D 19/0008 |
| 2003/0230906 | A1 * | 12/2003 | Bennett | B25B 9/02 294/99.2 |
| 2015/0053222 | A1 * | 2/2015 | Stoplos-Schaffer | A45D 29/007 132/73 |

OTHER PUBLICATIONS

Jamie Brock, How to Make Decorative Clothespins, https://feltmagnet.com/crafts/How-To-Make-Embellished-Clothespins, May 8, 2017, pp. 1-5.*

* cited by examiner

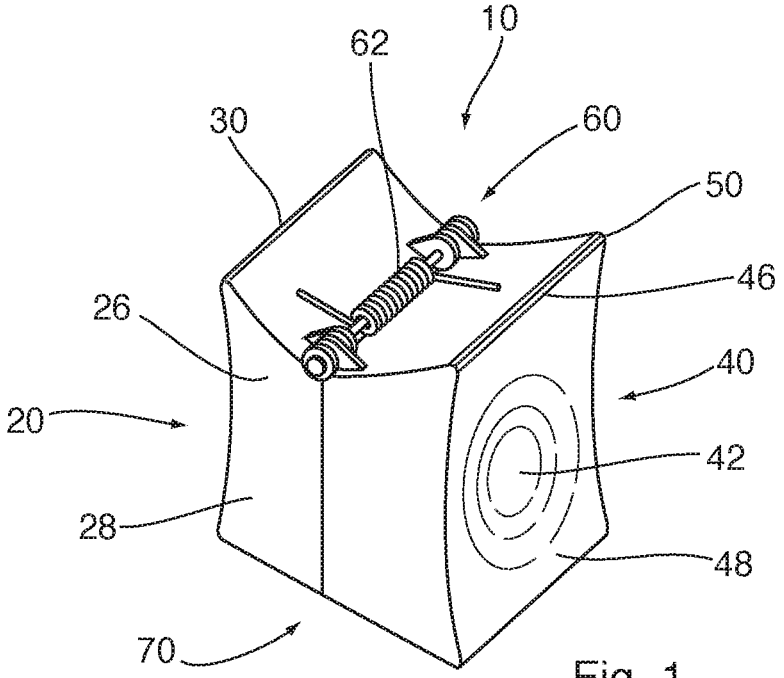
Fig. 1
Fig. 2
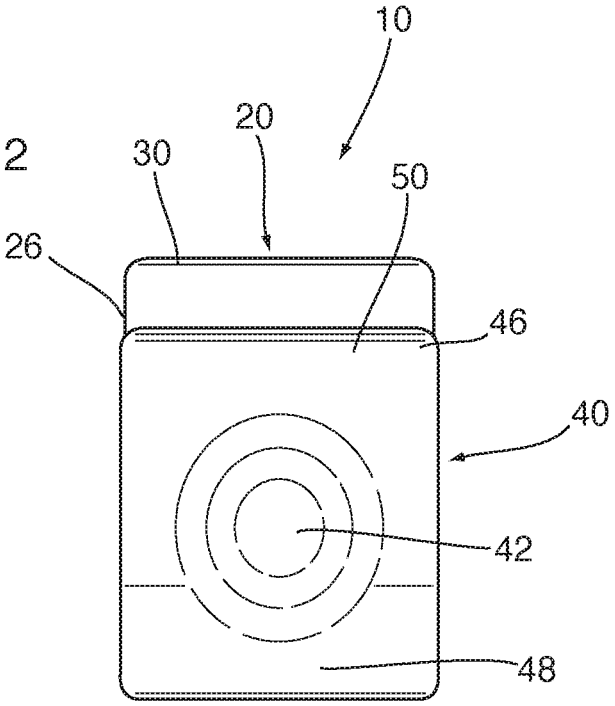

NAIL POLISH REMOVAL APPARATUS

FIELD

The embodiments described herein relate to the field of nail polish removal.

INTRODUCTION

The following paragraphs are not an admission that anything discussed in them is prior art or part of the knowledge of persons skilled in the art.

From time to time an individual may wish to remove nail polish which has been applied to a finger or toe nail. In some cases this removal may be accomplished by the use of a nail polish removal solution that is able to dissolve nail polish. A user of this nail polish removal solution may apply the nail polish removal solution by means of a removal agent to a target nail to remove nail polish from the target nail. This removal agent may include, but is not limited to, a cotton ball, a cotton pad, or a piece of fabric or tissue, for example, may be held by the user, infused with the nail polish removal solution, and rubbed against the target nail to dissolve and scour off nail polish.

However, it may be undesirable to have the user directly touch the removal agent since the nail polish removal solution infused in the removal agent may cause the user's skin to become red and irritated since nail polish removal solutions typically contain acetone. Furthermore, under chronic exposure to nail polish removal solution, the user's skin can become dry and cracked. In addition, it may be undesirable to have the user directly touch the removal agent as this may result in nail polish being unintentionally removed from the user's other nails when the user is holding the removal agent and trying to remove nail polish from the target nail.

SUMMARY

The embodiments described herein provide, in one aspect, an apparatus for removing nail polish, which generally comprise a first grip member comprising an upper end, a lower end, and a first removal support region; a second grip member comprising an upper end, a lower end, and a second removal support region; and a biasing portion coupling the first and second grip members, wherein the biasing portion biases the lower ends of the first and second grip members relative to one another; and wherein the first and second removal support regions form a single combined removal support region when the lower ends of the first and second grip members are adjacent to one another.

In at least one embodiment, the first grip member may comprise a first grip region on an outer surface thereof, and the second grip member may comprise a second grip region on an outer surface thereof, with both grip regions being shaped to allow a user to improve their grip of the apparatus.

In at least one embodiment, the first grip region may be between the upper and lower ends of the first grip member, and the second grip region may be between the upper and lower ends of the second grip member.

In at least one embodiment, the first grip region may be a first indent in the surface of the first grip member, and the second grip region may be a second indent in the surface of the second grip member.

In at least one embodiment, the first and second grip indents may have a same size or a different size and a same shape or a different shape.

In at least one embodiment, the removal support regions are on a lower surface of the first and second grip members.

In at least one embodiment, at least one of the first and second removal support regions is flat.

In at least one embodiment, at least one of the first and second removal support regions have an indent.

In at least one embodiment, the first and second removal support regions both have an indent positioned to provide a combined removal support region when the lower ends of the first and second grip members are adjacent to one another where the combined removal support regions includes an indent.

In at least one embodiment, the indents of the first and second removal support regions may have a same size or a different size and a same shape or a different shape.

In at least one embodiment, the combined removal support indent is a parabolic trough indent in the shape of a nail sized to match or be slightly larger than a target fingernail or toenail for which nail polish is to be removed.

In at least one embodiment, at least one of the first grip member comprises an inner surface facing the second grip member and the first removal support region is also on a lower end portion of the inner surface of the first grip member, and the second grip member comprises an inner surface facing the first grip member and the second removal support region is also on a lower end portion of the inner surface of the second grip member.

In at least one embodiment, the biasing force provided by the biasing portion may bias the lower ends of the first and second grip members towards one another.

In at least one embodiment, the biasing force provided by the biasing portion may bias the lower ends of the first and second grip members apart from one another.

In at least one embodiment, the biasing portion may comprise a spring.

In at least one embodiment, the spring may be a coil spring.

In at least one embodiment, the first and second grip members may each further comprise a handle extension on the upper end to allow a user to more easily counteract the biasing force of the biasing portion when moving the first and second members away from one another.

In at least one embodiment, the first and second grip members may each be 1 inch in height, 1 inch in length, and 0.5 inches in width.

In at least one embodiment, the first and second grip members may have a same shape or a different shape.

In another aspect, at least one of the embodiments described herein provide an apparatus for removing nail polish, comprising: a first grip member comprising an upper end and a lower end; a second grip member comprising an upper end and a lower end; a biasing portion connecting upper portions of the first and second grip members, wherein the biasing portion biases the lower ends of the first and second grip members relative to one another; and at least one removal support region on a lower surface of at least one of the first grip member and the second grip member, wherein during use a nail removal agent is held between the lower ends of the first and second grip members for removing nail polish from a target nail.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described.

FIG. 1 is a perspective view of an example embodiment of a nail polish removal apparatus in accordance with the teachings herein, where the apparatus is in a closed position and the lower ends of the first and second grip members are biased together.

FIG. 2 is a perspective view from one side of the apparatus of FIG. 1 in the closed position.

Figure 3:
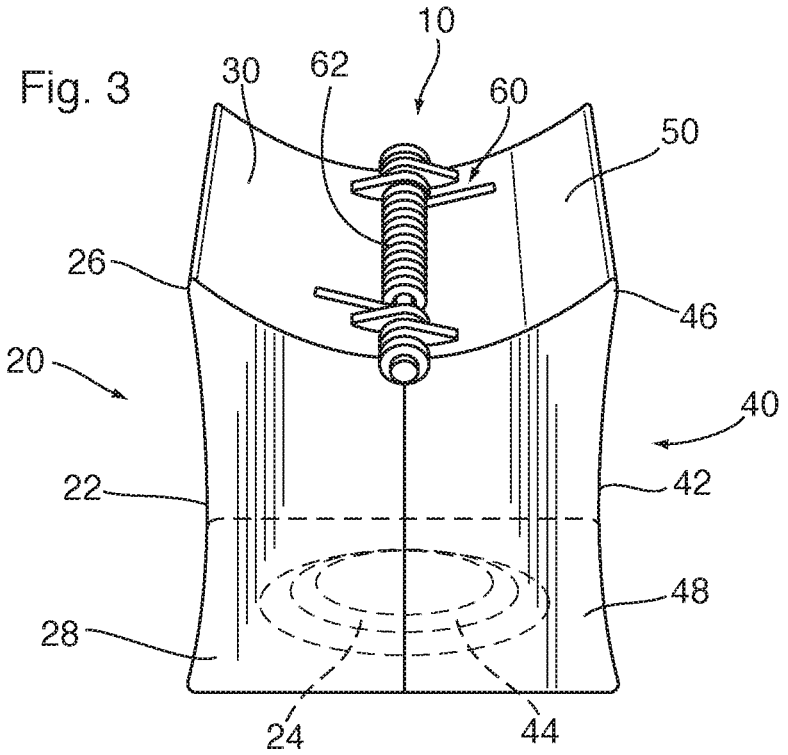
FIG. 3 is a perspective view from a first end of the apparatus of FIG. 1 in the closed position.

The skilled person in the art will understand that the drawings, further described below, are for illustration purposes only. The drawings are not intended to limit the scope of the applicants' teachings in any way. Also, it will be appreciated that for simplicity and clarity of illustration, elements shown in the figures have not necessarily been drawn to scale. For example, the dimensions of some of the elements may be exaggerated relative to other elements for clarity.

DESCRIPTION OF VARIOUS EMBODIMENTS

Various embodiments in accordance with the teachings herein will be described below to provide an example of at least one embodiment of the claimed subject matter. No embodiment described herein limits any claimed subject matter. The claimed subject matter is not limited to apparatuses or methods having all of the features of any one of the apparatuses or methods described below or to features common to multiple or all of the apparatuses or methods described herein. It is possible that there may be an apparatus or method described herein that is not an embodiment of any claimed subject matter. Any subject matter that is described herein that is not claimed in this document may be the subject matter of another protective instrument, for example, a continuing patent application, and the applicants, inventors or owners do not intend to abandon, disclaim or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have a mechanical connotation and indicate that two elements or devices can be directly connected to one another or connected to one another through one or more intermediate elements, depending on the particular context.

It should also be noted that, as used herein, the wording "and/or" is intended to represent an inclusive-or. That is, the text "X and/or Y" is intended to mean X or Y or both, for example. As a further example, the text "X, Y, and/or Z" is intended to mean X or Y or Z or any combination thereof.

It should be noted that terms of degree such as "substantially", "similarly", "about" and "approximately" as used herein mean a reasonable amount of deviation of the modified term such that the end result is not significantly changed. These terms of degree may also be construed as including a deviation of the modified term, such as 1%, 2%, 5%, or 10%, for example, if this deviation does not negate the meaning of the term it modifies.

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as up to 10%, for example.

Figure 4:
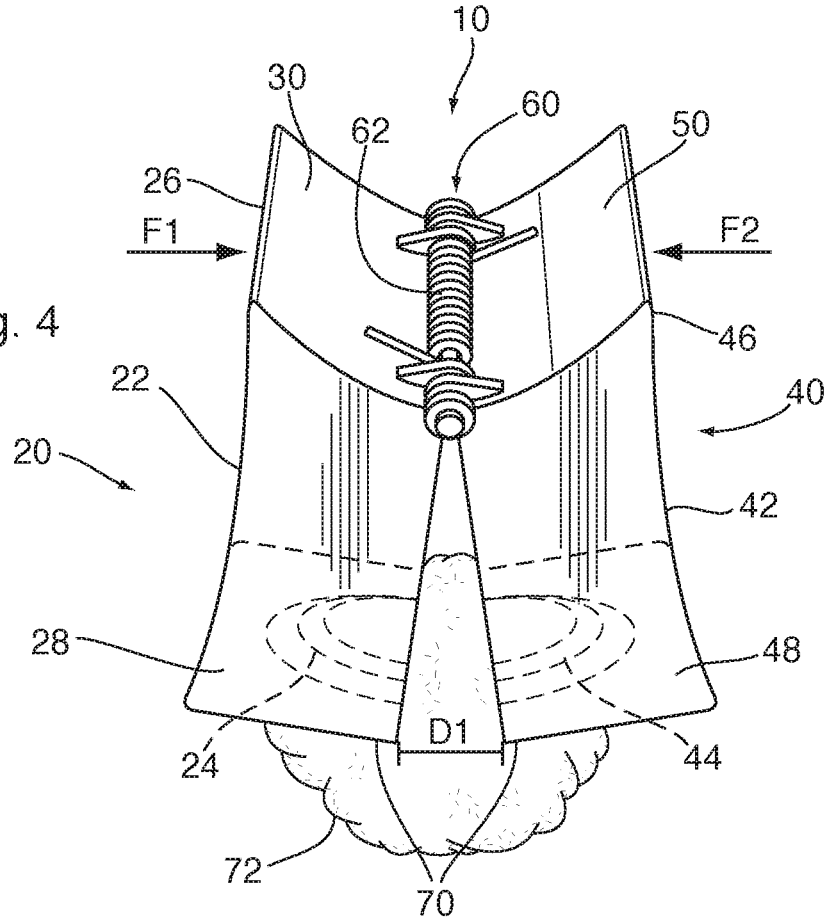
FIG. 4 is a perspective view from the first end of the apparatus of FIG. 1, where the apparatus is in an operational position and the lower ends of the first and second grip members are moved apart from one another to grip a removal agent.
Figure 5:
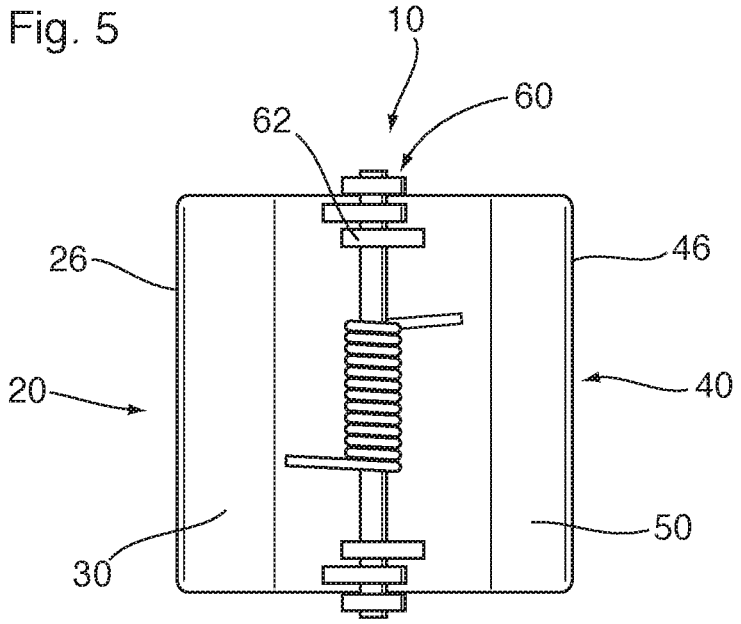
FIG. 5 is a top view of the apparatus of FIG. 1, where the apparatus is in the closed position or the operational position.

Reference is now made to FIGS. 1 to 8, depicting an example embodiment of a nail polish removal apparatus 10 in accordance with the teachings herein. The nail polish removal apparatus 10 generally comprises a first grip member 20, a second grip member 40 and a biasing portion 60. As depicted in FIG. 3, the first lower end 28 of the first grip member 20 and the second lower end 48 of the second grip member 40 are in a 'closed' position in which the first and second lower ends 28 and 48 are biased by the biasing portion 60 to be in very close proximity to one another or substantially resting against one another. As depicted in FIG. 4, the first lower end 28 of the first grip member 20 and the second lower end 48 of the second grip member 40 can also be moved apart from one another when forces F1 and F2 are applied to move the apparatus 10 into an 'open' position in which the first and second lower ends 28 and 48 are separated by at least a first distance 72. The forces F1 and F2 may be applied when the user pinches the top sides of the apparatus 10.

The biasing portion 60 biases the lower ends of the first and second grip members 20 and 40 towards one another so that the apparatus is in the closed or operational position. Therefore, the user applies the forces F1 and F2 to move the lower ends of the first and second grip members 20 and 40 apart, places the lower ends of the first and second grip members 20 and 40 around the removal agent 72 so that the removal agent 72 is therebetween and then the user stops applying the forces F1 and F2 so that the lower ends of the first and second grip members 20 and 40 move towards one another and grasp the removal agent 72. This may assist the user when they desire to grasp the removal agent 72 for an extended period of time.

Alternatively, in at least one embodiment, the biasing portion 60 may be implemented to bias the first and second grip members 20 and 40 away from one another such that the apparatus 10 is normally in an open position. Accordingly, when the user wishes to grasp the removal agent 72 they must constantly apply the forces F1 and F2 to the biasing portion 60 to pick up the removal agent 72 and maintain a grip around the removal agent 72. This embodiment may assist the user in grasping the removal agent 72 for short periods of time, and enable easy exchanging of one removal agent for another.

The biasing portion 60 may be implemented using a coil spring 62 as shown in the figures. Alternatively, in other embodiments, the biasing portion 60 may be implemented using a resilient piece of rubber or plastic or wire that has a memory shape to either bias the first and second grip members 20 and 40 towards one another or away from one another absent the application of external forces F1 and F2. In such embodiments, the first grip member 20, the second grip member 40, and the biasing portion 60 may be a single continuous object, such as a 'U' or 'C' shaped object.

Each of first and second grip members may further comprise a handle extension 30 and 50. The handle extensions 30 and 50 may extend from the upper ends 26 and 46 of the first and second grip members 20 and 40, and may be flared or curved outwards to enable the user to more easily apply pressure to counteract the biasing force of the biasing portion 60 biasing the lower ends 28 and 48 of the first and second grip members 20 and 40 towards or away from one another depending on how the biasing portion 60 is implemented.

The apparatus 10 is portable and small in size such that it is easy for a user to handle the apparatus 10 with only a couple of their fingers. The apparatus 10 permits a user to hold a removal agent 72, which may be a porous material for example, that is infused with nail polish removal solution without having contact between the removal agent 72 and the fingers or thumbs of the user that are used to apply the removal agent 72 to a target nail to remove nail polish from the target nail. Accordingly, the apparatus 10 permits the user to grasp a removal agent 72, such as a cotton ball, a cotton pad, a tissue or a fabric, and move the removal agent 72 to a bottle of nail polish removal solution to absorb a portion thereof, and then apply the removal to the target nail, without touching the removal agent 72 with the nail polish removal solution to any non-target finger nails.

While a generic tweezer-like apparatus may be used to hold a removal agent 72 infused with nail polish removal solution, the generic tweezer-like apparatus may not adequately facilitate the application of pressure to the curved surface of a target finger or target toe nail while removing nail polish therefrom. Specifically, a generic tweezer-like apparatus may not provide a desired level of support to a removal agent 72 which is applied to a target nail since a tweezer does not have enough surface area to allow the user to hold the tweezer-like apparatus with their other fingers while properly making contact with the target nail which in turn can allow for error and other fingernails to get ruined.

Figure 6:
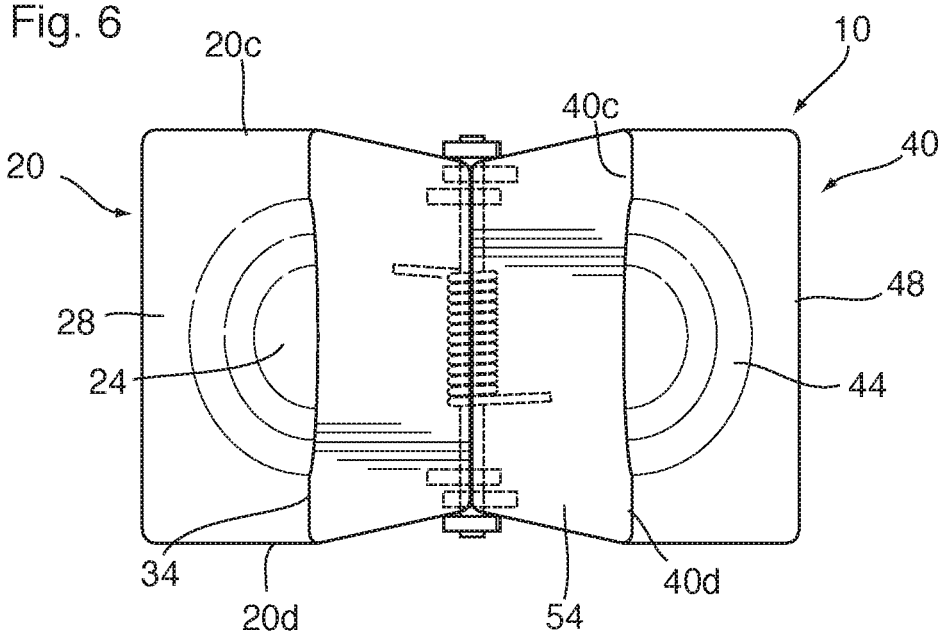
FIG. 6 is a bottom view of the apparatus of FIG. 1, where the apparatus is in the open position and the lower ends of the first and second grip members are forced apart from one another and separated by a first distance.

Advantageously, the first grip member 20 comprises a first removal support region 24 at a bottom portion thereof and the second removal grip member 40 comprises a second removal support region 44 at a bottom portion thereof. As shown in FIG. 6, the first and second removal support regions 24 and 44 may each comprise an indented portion that is curved to be somewhat similar to the curvature of the surface of a person's toe or finger nail. When the first and second lower ends of the first and second grip members 20 and 40 are adjacent to one another and grip the removal agent 72 therebetween, the apparatus 10 is in an operation position, as shown in FIG. 4, and where the indented portions of the first and second removal support regions 24 and 44 combine to form a combined removal support indent that has a shape like the complete shape of a finger or toe nail but is slightly larger in size than a person's typical fingernail and/or toenail. Accordingly, in these embodiments the removal support regions 24 and 44 each have an indent that have a half-nail shape.

Figure 7:
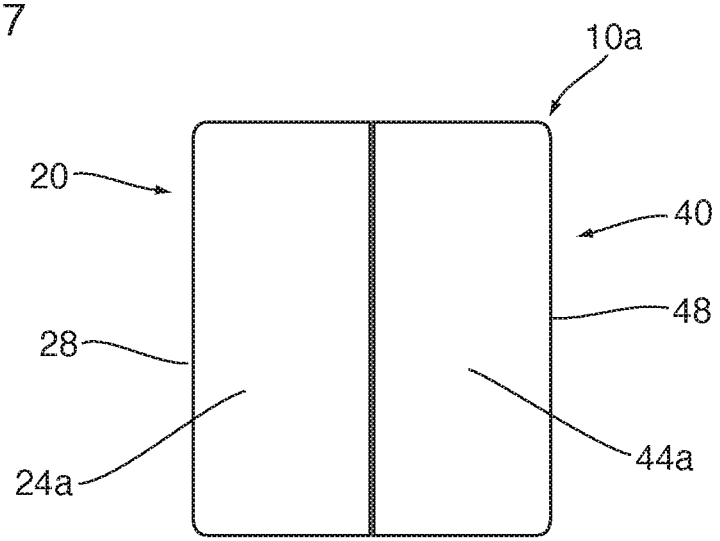
FIG. 7 is a bottom view of an alternative example embodiment of a nail polish removal apparatus, where the apparatus is in closed position.
Figure 8:
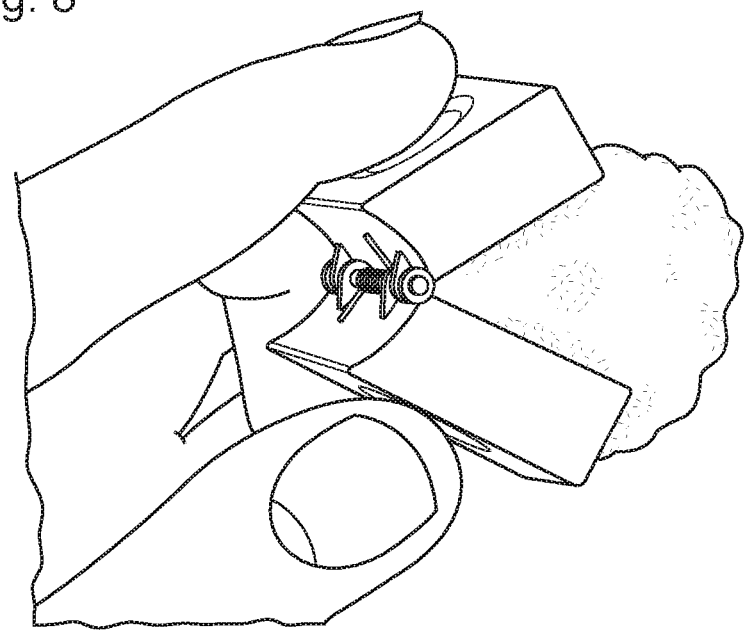
FIG. 8 is a view of the apparatus of FIG. 1 during use.

Alternatively, in at least one alternative embodiment, as shown in FIG. 7 in a bottom view, there is a nail polish removal apparatus 10*a* with first and second removal support regions 24*a* and 44*a* that provide a substantially flat surface area that is greater than the size of the target nail for which polish must be removed and this surface area allows the user to apply a desired amount of pressure to the target nail when removing nail polish therefrom. In this embodiment, the first and second removal support regions 24*a* and 44*a* do not have an indent or concave surface.

Generally, in both embodiments the first and second removal support regions allow the user to apply even pressure to the full surface and nail bed of a curved target nail, permitting easier and faster removal of nail polish from the target nail. In particular, the shape of the surfaces for the first and second removal support regions 24 and 44 (or alternatively 24*a* and 44*a*) permit the user to remove nail polish from the target nail by applying a pressure through the apparatus 10 (or 10*a*) and removal agent 72 to at least a major portion of the surface of the target nail without having to maneuver the apparatus at different angles. Also, the indents of the first and second removal support regions 24 and 44 can be shaped to accommodate (i.e. fit or be slightly larger in size) both fingernails and toenails of different sizes.

As depicted, the first and second removal support regions 24 and 44 are symmetrical regions. A nail polish removal apparatus with symmetrical first and second removal support regions 24 and 44 may enable a more convenient use of the apparatus in applying the removal agent 72 to the target nail, as the user may not need to rotate the apparatus to enable the user to perform similar application actions to each side of a nail.

It should be understood that there can be many variations in the first and second grip members 20 and 40. As depicted, the first and second grip members 20 and 40 may each have a block-like shape that is square or rectangular. The block-like nature of the grip members 20 and 40 contribute to increased durability to allow the user to use the apparatus 10 or 10*a* for extended periods of use. The block-like shape of the grip members 20 and 40 also provide additional surface area on the lower surfaces in addition to the removal support regions to aid in removing nail polish from the target nail. This improves comfort as there are no sharp points that make contact with the user's fingers or toes when the user is using the apparatus 10.

Figure 9A:
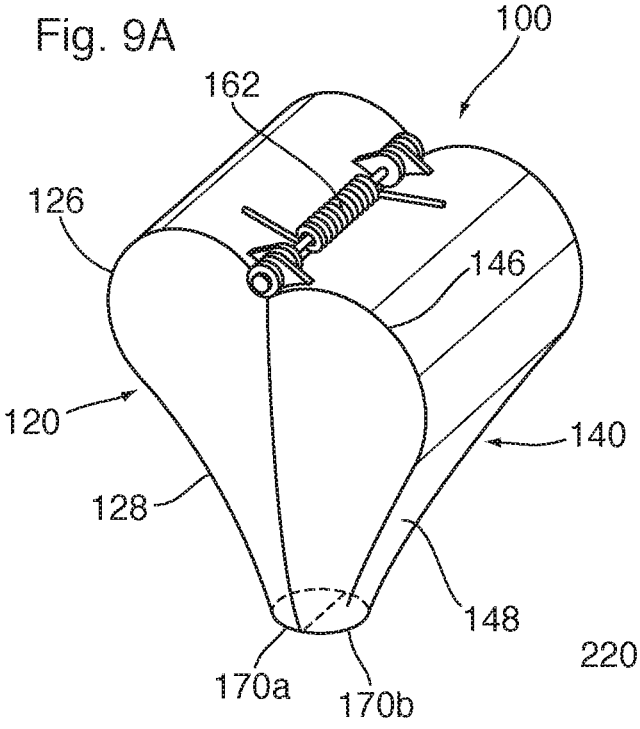
FIGS. 9A-9C are views of alternative embodiments of the nail polish removal apparatus.
Figure 9B:
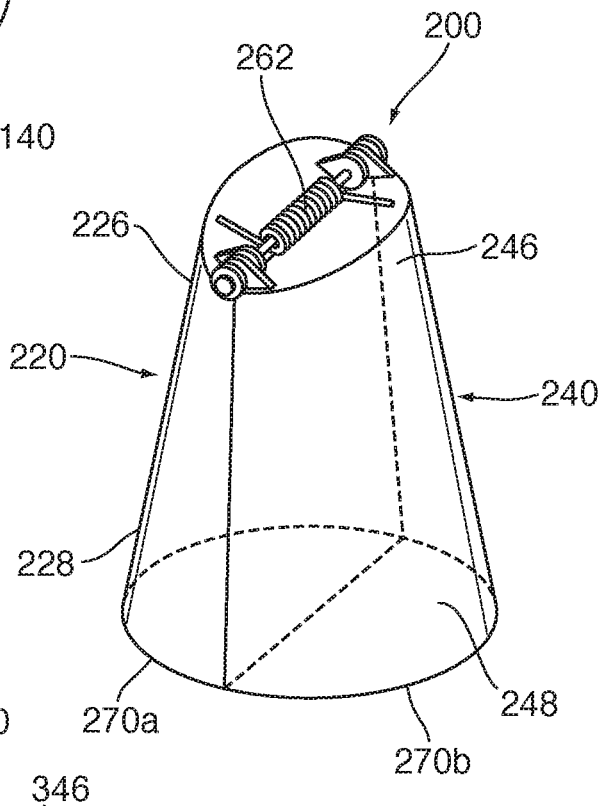

In alternative embodiments, the first and second grip members may have symmetrical shapes that are each half of an overall combined shape so that when they are adjacent they form an object having the overall combined shape. For example, referring to FIG. 9A, shown therein is a side view of apparatus 100 where the majority of the grip members 120 and 140 each provide half of a heart shape and when the apparatus 100 is in the closed position the grip members 120 and 140 together form a heart-shaped object. FIG. 9B shows a side view of apparatus 200 where the majority of the grip members 220 and 240 each provide half of a cone or conical shape and when the apparatus 200 is in the closed position the grip members 220 and 240 together form a cone. The grip members 120 and 140 also comprise upper ends 126 and 146, respectively, and lower ends 128 and 148, respectively that may be similar to upper ends 26 and 46 as well as lower ends 28 and 48, respectively, of apparatuses 10*a* or 10*b*.

For both apparatuses 100 and 200, the grip members 120 and 140 each have removal support regions 170*a* and 170*b*, respectively, that can be flat or have an indent and be sized as explained previously for apparatuses 10 and 10*a*, as well as a biasing portion having a spring 162 in this example. In addition, for both of the apparatuses 100 and 200, in alternative embodiments, the top portions of the grip members 120 and 140 or 220 and 240 can be shaped to curve outwards and provide a handle extension as explained for the previous apparatus embodiments 10 and 10*a*. The grip members 220 and 240 also comprise upper ends 226 and 246, respectively, and lower ends 228 and 248, respectively that may be similar to upper ends 26 and 46 as well as lower ends 28 and 48, respectively, of apparatuses 10*a* or 10*b*.

In alternative embodiments, the shape of the grip members can have symmetrical shapes and together form an object having a shape other than what is shown in FIGS. 9A and 9B. For example, in the grip members can be shaped so that together they provide other shapes including, but not limited to, a cuboid shape, a triangular shape, a semi-circular shape, a diamond shape, different types of polygonal shapes, an oval shape, different types of quadrilateral shapes, a plus sign shape, a cylinder shape, a spherical shape, a circular shape, a tetrahedral shape, an octahedral shape, a dodecahedral shape, an icosahedral shape, a square or hexagonal pyramid shape, an ellipsoid shape, or a triangular, hexagonal or pentagonal prism shape. For shapes that have pointed bottom portions, a base region can be used to provide the removal support regions as is shown in FIG. 9*a*.

Figure 9C:
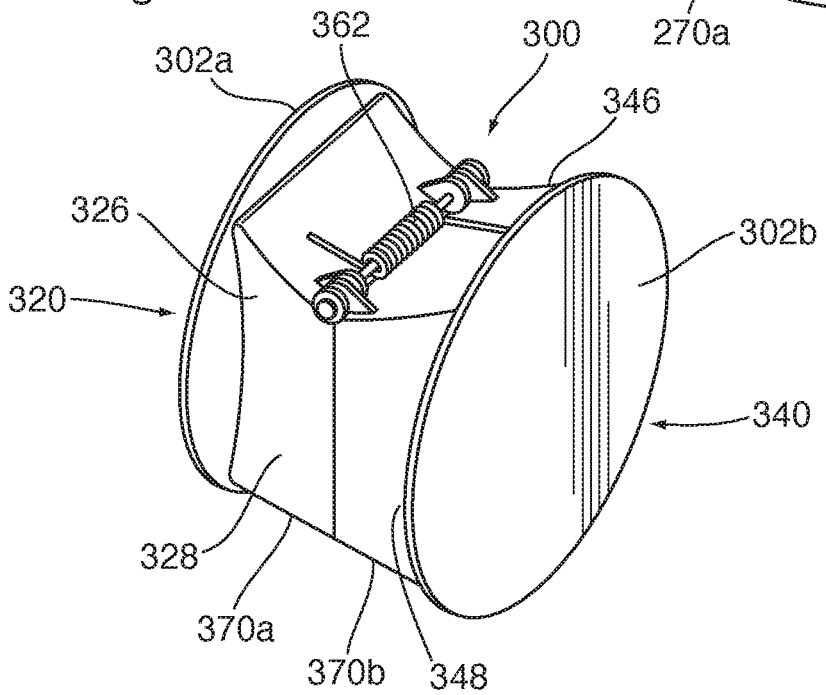

In alternative embodiments, the first and second grip members themselves may have additional side portions that have a certain given shape. These additional side portions may be attached to the first and second grip members using some known fastener such as glue for example or they may integrally formed with the first and second grip members. For example, referring to FIG. 9C, shown therein is a perspective view of apparatus 300 with grip members 320 and 340 with additional side portions 302*a* and 302*b* respectively where the side portions have a circular shape. The grip members 320 and 340 also comprise upper ends 326 and 346, respectively, and lower ends 328 and 348, respectively that may be similar to upper ends 26 and 46 as well as lower ends 28 and 48, respectively, of apparatuses 10*a* or 10*b*. However, the remainder of the apparatus is similarly shaped as described for apparatus 10*a* or 10*b* having removal support regions 370*a* and 370*b*, respectively, that can be flat or have an indent and be sized as explained previously for apparatuses 10 and 10*a*, as well as a biasing portion having a spring 362 in this example.

In alternative embodiments, the additional portions of the grip members can have other shapes including, but not limited to, a cuboid shape, a triangular shape, a semi-circular shape, a diamond shape, different types of polygonal shapes, an oval shape, different types of quadrilateral shapes, a plus sign shape, a cone shape, a cylinder shape, a spherical shape, a tetrahedral shape, an octahedral shape, a dodecahedral shape, an icosahedral shape, a square or hexagonal pyramid shape, an ellipsoid shape, or a triangular, hexagonal or pentagonal prism shape, for example.

In some embodiments, the first and second grip members can have a different shape compared to one another.

As depicted, the first and second grip members 20 and 40 have first and second inner surfaces 34 and 54, respectively, that may be substantially flat surfaces, and rest against one another or are in close proximity to one another along substantially their entire height and width when the first and second lower ends of the first and second grip members 20 and 40 are together. However, in an alternative embodiment, the first and second grip members 20 and 40 may also be bowed outward, such that a cavity or gap is formed between the first and second grip inner surfaces 34 and 54 between the upper and lower ends of the first and second grip members 20 and 40. This cavity may enable the user to grasp a larger removal agent 72. A larger removal agent 72 may hold a larger amount of nail polish removal solution, and may enable the user to remove more polish with a single infusion of the removal agent 72 with nail polish removal solution.

In an alternative embodiment, the first and second grip members 20 and 40 may also be asymmetrical (e.g. have different shapes). Asymmetrical grip members may enable a user to perform different actions with different parts of the combined lower end, or may provide the user with a variety of options for holding the nail polish removal apparatus. However, as depicted, the first and second grip members 20 and 40 may also have symmetrical shapes.

In various embodiments of the nail polish removal apparatuses 10, 10*a*, 100, 200 or 300, the height of first and second grip members may be less than 5 inches, less than 3 inches, less than 2 inches, or less than 1 inch. This may facilitate ease of use, as the user may have to stretch to position the hand that they are using to hold the apparatus 10, 10*a*, 100, 200 or 300 closer to the target nail when smaller heights like 1 inch are being used or the user may not have to stretch as much when working with an apparatus 10, 10*a*, 100, 200 or 300 having a larger height.

In various embodiments of the nail polish removal apparatuses shown herein, the width of first and second grip members may be less than 3 inches, less than 2 inches, less than 1 inch, or less than ½ an inch. This may also facilitate ease of use, as the combined width of the apparatuses described herein, being the combined width of the first and second grip members, can be made wide enough to enable the user to more comfortably grip the apparatus 10 or 10*a*, while being narrow enough to enable ease of use.

In various embodiments of the nail polish removal apparatuses described herein, the length of the first and second grip members may be less than 5 inches, less than 3 inches, less than 2 inches, or less than 1 inch. This may also facilitate ease of use, as a length of the grip members that is closer to the length of a nail may enable ease of use.

As depicted for the apparatus 10, the combined removal support indent 70 is a concave indent in the combined lower end of the apparatus 10; formed when the first and second removal support regions 24 and 44 are also at least partially concave. As depicted, the combined removal support indent 70 may substantially mirror the shape of a finger or toe nail, to enable first and second removal support regions 24 and 44 to better support the removal agent 72 when it is applied against the target nail.

However, many different embodiments of first and second removal support regions are contemplated. As depicted, the first and second removal support regions 24 and 44 may be curved surfaces, in which case the combined removal support indent may be a parabolic trough indent running along the entire length of the lower surface of the apparatus. This embodiment may provide the user with a degree of control over gripping the removal agent 72 closer to a front surface (e.g. 20*c* and 40*c*) or back surface (e.g. 20*d* and 40*d*) of the apparatus which may be preferable depending on how the user prefers to use the apparatus to remove nail polish from target nails. An examples of surfaces 20*c*, 40*c*, 20*d*, and 40*d* is shown in FIG. 6.

In contrast, as shown in FIG. 6, the first and second removal support regions 24 and 44 run about ⅓ to ½ of the length of the lower surface of the apparatus and disposed in the middle of the lower surface of the first and second grip member 20 and 40. Alternatively, in other embodiments, the first and second removal support regions 24 and 44 may be positioned so that they may be closer but not extend to contact with the front walls 20*c* and 40*c* of the grip members 20 and 40 or the back walls 20*d* and 40*d* of the grip members 20 and 40. In another alternative, in some embodiments, the first and second removal support regions 24 and 44 may be positioned so that they extend to and make contact with the front walls 20*c* and 40*c* of the grip members 20 and 40 or the back walls 20*d* and 40*d* of the grip members 20 and 40. These variations for the first and second removal support regions may be applied to at least one of the other apparatuses described herein in at least one alternative embodiment.

Alternatively, the lower portions of the inner surfaces of the first and second grip members that are in close proximity to one another (see the surfaces near the label D1 in FIG. 4) when the apparatus is in the closed position may be upwardly angled, in which case the combined removal support indent may be shaped as a conical trough indent that runs along a portion or entire length of bottom of the apparatus.

In alternative embodiments, the first and second removal support regions may have alternative shapes such that they combine to form various other combined removal support indents such as an oval indent, a circular indent, a rectangular indent, an indent of uniformly decreasing width along the length of the combined lower end of the apparatus, or an asymmetrical indent.

In an alternate embodiment, the first and second removal support regions 24 and 44 may be asymmetrical in nature having different surface areas, or different shapes, or different indented regions. For example, in some embodiments, one of the removal support regions may be longer, wider and/or deeper than the other removal support region which facilitates holding the apparatus at an angle to the target nail rather than holding the apparatus so that it is vertically straight. Accordingly, in such embodiments, the combined removal support indent may be asymmetrical and shifted to one side of the lower surface of the apparatus, for example.

In at least some embodiments, the first and second grip members 20 and 40 may further comprise optional first and second grip regions 22 and 42 that are on outer surfaces of the sides of the first and second grip members, respectively. Each of first and second grip regions 22 and 42 may be a single indent provided to receive one of the user's finger tips allowing the user to better grip the apparatus 10 or 10*a*. These grip regions can also be applied to the other apparatuses described herein in alternative embodiments. The first and second grip regions 22 and 42 may each be single concave indents. Alternatively, one or both of first and second grip regions 22 and 42 may comprise two or more concave indents to receive two or more of the user's fingertips, to permit the user to apply additional pressure and to allow the user to benefit from additional finer control in handling the apparatus 10 or 10*a*. The grip regions 22 and 42 can have many different types of shapes such as, but not limited to, a circular shape, a fingertip shape, an oval shape, a square shape, a rectangular shape, a triangular shape, a semi-circular shape, a diamond shape, an octagon shape, a hexagon shape, a polygonal shape and a heart shape, for example. The grip regions 22 and 42 can allow for greater comfort for the user since the surface area of the grip regions 22 and 42 can be larger than the surface of the finger pads of the user which allows the user's finger pads to rest comfortably on the grip members 20 and 40 when using the apparatus.

The first and second grip regions 22 and 42 may be provided for user comfort and to facilitate ease of use of any of the apparatuses described herein. For example, the user may hold one of the apparatuses described herein using the grip regions 22 and 42 instead of the handle regions 30 and 50. Comfortable use of the apparatus may be helpful, particularly when the apparatus is used for an extended period of time, such as by a professional manicurist. The grip regions 22 and 42 may also allow for better control of the apparatus when removing the nail polish by permitting the user to apply pressure to the target nails more easily and evenly.

The various embodiments of the nail polish removal apparatus described herein can be made using materials that are safe to the human touch. For example, various plastics may be used that are bio-compatible such as, but not limited to, PVC, Polyethylene, Polycarbonate, PEEK, Polysulfone, Ultem PEI, Polyurethane and Polypropylene, for example, that are at medical quality standards. Alternatively, other materials that are bio-compatible may be used to construct the nail polish removal apparatus such as, but not limited to, wood, metal, ceramic, glass, steels, aluminum, concrete, or plaster, for example. The material is chosen not only to be bio compatible but also to withstand deterioration when exposed to nail polish removal solution.

The various embodiments of the nail polish removal apparatus described herein allow the user to remove nail polish from single or multiple target nails without having the removal agent or the user's fingers making contact with other painted finger or toe nails thereby avoiding the ruining of any other painted nails or avoiding the excess nail polish that is being removed from staining of the fingers of the user of the apparatus. The shape and structure of the apparatuses described herein also allow the user to hold the apparatus at any time without having to worry about ruining their fingernail polish and also allow for gripping removal agents of different sizes and shapes.

The nail polish removal apparatus also allows for nail polish to be removed from a target fingernail or toenail without having to soak the target nail into a nail polish removal solution. Therefore, the person who is having their nail polish removed as well as the user of the apparatus do not have to be exposed to harsh nail polish removal chemicals. This is important to people who are always around nail polish removal solution such as nail technicians. This is also important to health-conscious consumers.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

The invention claimed is:

1. An apparatus for removing nail polish, comprising:

a first grip member comprising:

a first outer wall having an upper end, a lower end, a front edge and a back edge;

a first top wall extending transversely from the first outer wall, the first top wall having an outer edge, a front edge and a back edge, the outer edge of the first top wall forming an adjoining edge with the upper end of the first outer wall;

a first front wall extending transversely from the first outer wall, the first front wall having an upper end, a lower end, an outer edge and an inner edge, the outer edge of the first front wall forming an adjoining edge with the front edge of the first outer wall and the upper end of the first front wall forming an adjoining edge with the front edge of the first top wall;

a first back wall extending transversely from the first outer wall, the first back wall having an upper end, a lower end, an outer edge and an inner edge, the outer edge of the first back wall forming an adjoining edge with the back edge of the first outer wall and the upper end of the first back wall forming an adjoining edge with the back edge of the first top wall;

a first bottom wall extending transversely and inwardly from the first outer wall and also joining the first front and back walls, the first bottom wall having a front edge, a back edge, an outer edge and an inner edge, the front edge of the first bottom wall forming an adjoining edge with the lower end of the first front wall, the outer edge of the bottom wall forming an adjoining edge with the lower end of the first outer wall and the back edge of the bottom wall forming an adjoining end with the lower end of the first back wall, the first bottom wall further having a first removal support region with a first semi-circular indent on the first bottom wall extending radially outward from a central location on the inner edge and flat peripheral portions extending from an outer periphery of the first semi-circular indent; and a second grip member that is movably coupled to the first grip member, the second grip member comprising:

a second outer wall having an upper end, a lower end, a front edge and a back edge;

a second top wall extending transversely from the second outer wall, the second top wall having an outer edge, a front edge and a back edge, the outer edge of the second top wall forming an adjoining edge with the upper end of the second outer wall;

a second front wall extending transversely from the second outer wall, the second front wall having an upper end, a lower end, an outer edge and an inner edge, the outer edge of the second front wall forming an adjoining edge with the front edge of the second outer wall and the upper end of the second front wall forming an adjoining edge with the front edge of the second top wall;

a second back wall extending transversely from the second outer wall, the second back wall having an upper end, a lower end, an outer edge and an inner edge, the outer edge of the second back wall forming an adjoining edge with the back edge of the second outer wall and the upper end of the second back wall forming an adjoining edge with the back edge of the second top wall;

a second bottom wall extending transversely and inwardly from the lower end of the second outer wall and also joining the second front and back walls, the second bottom wall having a front edge, a back edge, an outer edge and an inner edge, the front edge of the second bottom wall forming an adjoining edge with the lower end of the second front wall, the outer edge of the second bottom wall forming an adjoining edge with the lower end of the second outer wall and the back edge of the second bottom wall forming an adjoining end with the lower end of the second back wall, the second bottom wall having a second removal support region with a second semi-circular indent on the second bottom wall extending radially outward from a central location on the inner edge and flat peripheral portions extending from an outer periphery of the second semi-circular indent; and a biasing portion coupling the first and second grip members to one another, wherein the biasing portion biases the inner edges of the first front and back walls of the first grip member to abut with the inner edges of the second front and back walls of the second grip member in a closed position;

wherein when the first and second grip members are in the closed position, the first and second removal support regions form a single combined removal support region where the first and second semi-circular indents abut to form a concave circular recess completely bound by the flat peripheral portion.

2. The apparatus of claim 1, wherein the first grip member comprises a first grip region on an outer surface of the first outer wall; and the second grip member comprises a second grip region on an outer surface of the second outer wall; with the first grip region having at least a first indent and the second grip region having at least a second indent to allow a user to grip the apparatus.

3. The apparatus of claim 1, wherein an outer surface of the first outer wall has a concave curve that extends from the upper end to the lower end of the first outer wall and provides a first grip region for the first grip member, and an outer surface of the second outer wall has a concave curve that extends from the upper end to the lower end of the first outer wall and provides a second grip region for the second grip member.

4. The apparatus of claim 2, wherein the at least one first indent and the at least one second indent have a same size or a different size and a same shape or a different shape.

5. The apparatus of claim 2, wherein the first and second semi-circular indents of the first and second removal support regions have a same size or a different size.

6. The apparatus of claim 1, wherein:

the first grip member further comprises an inner wall that adjoins to the edges of at least the bottom wall, top wall, back wall and front wall and faces the second grip member and the first removal support region is also on a lower end portion of the inner wall of the first grip member; and/or, the second grip member further comprises an inner wall that adjoins to the edges of at least the bottom wall, top wall, back wall and front wall and faces the first grip member and the second removal support region is also on a lower end portion of the inner wall of the second grip member.

7. The apparatus of claim 1, wherein the first top wall extends from the upper end of the first outer wall inwardly and downwardly to a first inner edge, the second top wall extends from the upper end of the second outer wall inwardly and downwardly to a second inner edge and the biasing portion comprises a spring that is disposed along the first and second inner edges of the first and second top walls to connect the first and second grip members.

8. The apparatus of claim 1, wherein the first and second grip members each further comprise a handle extension at upper end portions of the first and second outer walls to receive a finger or a thumb of a user when the user applies inwardly directed forces to counteract the biasing force of the biasing portion in order to move the first and second grip members away from one another.

9. The apparatus of claim 1, wherein the first and second grip members have a same shape or a different shape.

10. The apparatus of claim 1, wherein the first and second grip members have symmetrical shapes or non-symmetrical shapes that are each half of an overall combined shape.

11. The apparatus of claim 1, wherein the outer surfaces of the first and second outer walls of the first and second grip members comprise additional side portions having a circular shape, an oval shape, a square shape, a rectangular shape, a triangular shape, a semi-circular shape, a diamond shape, an octagon shape, a hexagon shape, a polygonal shape or a heart shape.

12. An apparatus for removing nail polish, comprising:

a first grip member comprising:

a first outer wall having an upper end, a lower end, a front edge and a back edge, the first outer wall having a first inwardly curved surface, a first top wall extending transversely from the first outer wall, the first top wall having an outer edge, an inner edge, a front edge and a back edge, the outer edge of the first top wall forming an adjoining edge with the upper end of the first outer wall;

a first front wall extending transversely from the first outer wall, the first front wall having an upper end, a lower end, an outer edge and an inner edge, the outer edge of the first front wall forming an adjoining edge with the front edge of the first outer wall and the upper end of the first front wall forming an adjoining edge with the front edge of the first top wall;

a first back wall extending transversely from the first outer wall, the first back wall having an upper end, a lower end, an outer edge and an inner edge, the outer edge of the first back wall forming an adjoining edge with the back edge of the first outer wall and the upper end of the first back wall forming an adjoining edge with the back edge of the first top wall;

a first bottom wall extending transversely and inwardly from the first outer wall and also joining the first front and back walls, the first bottom wall having a front edge, a back edge, an outer edge and an inner edge, the front edge of the first bottom wall forming an adjoining edge with the lower end of the first front wall, the outer edge of the bottom wall forming an adjoining edge with the lower end of the first outer wall and the back edge of the bottom wall forming an adjoining end with the lower end of the first back wall;

a first removal support region having a first semi-circular indent on the first bottom wall extending radially from a central location on the inner edge of the first bottom wall; and flat peripheral portions on the first bottom wall that extend outward from an outer periphery of the first semi-circular indent;

a second grip member that is movably coupled to the first grip member, the second grip member comprising:

a second outer wall having an upper end, a lower end, a front edge and a back edge, the second outer wall having a second inwardly curved surface;

a second top wall extending transversely from the second outer wall, the second top wall having an outer edge, an inner edge, a front edge and a back edge, the outer edge of the second top wall forming an adjoining edge with the upper end of the second outer wall;

a second front wall extending transversely from the second outer wall, the second front wall having an upper end, a lower end, an outer edge and an inner edge, the outer edge of the second front wall forming an adjoining edge with the front edge of the second outer wall and the upper end of the second front wall forming an adjoining edge with the front edge of the second top wall;

a second back wall extending transversely from the second outer wall, the second back wall having an upper end, a lower end, an outer edge and an inner edge, the outer edge of the second back wall forming an adjoining edge with the back edge of the second outer wall and the upper end of the second back wall forming an adjoining edge with the back edge of the second top wall;

a second bottom wall extending transversely and inwardly from the lower end of the second outer wall and also joining the second front and back walls, the second bottom wall having a front edge, a back edge, an outer edge and an inner edge, the front edge of the second bottom wall forming an adjoining edge with the lower end of the second front wall, the outer edge of the second bottom wall forming an adjoining edge with the lower end of the second outer wall and the back edge of the second bottom wall forming an adjoining end with the lower end of the second back wall;

a second removal support region having a second semi-circular indent on the second bottom wall extending radially from a central location on the inner edge of the second bottom wall; and flat peripheral portions on the first bottom wall that extend outward from an outer periphery of the second semi-circular indent; and a biasing portion disposed at an upper portion of the apparatus and connecting the inner edges of the first and second top walls of the first and second grip members, wherein the biasing portion biases the lower ends of the first and second grip members to abut one another and the first and second semi-circular indents to abut to form a circular concave recess completely bound by the flat peripheral portions;

wherein during use a nail polish removal agent is held between the inner edges of the first and second bottom walls of the first and second grip members for removing nail polish from a target nail.

* * * * *